US007966673B1

(12) United States Patent
Gibson

(10) Patent No.: US 7,966,673 B1
(45) Date of Patent: Jun. 28, 2011

(54) PROTECTIVE SHIELD FOR A CAP

(76) Inventor: Edwin Lowell Gibson, Vallejo, CA (US)

( * ) Notice: Subject to any disclaimer, the term of this patent is extended or adjusted under 35 U.S.C. 154(b) by 0 days.

(21) Appl. No.: 12/589,704

(22) Filed: Oct. 26, 2009

(51) Int. Cl.
*A42B 3/10* (2006.01)
*A42B 1/08* (2006.01)
*A42B 1/00* (2006.01)

(52) U.S. Cl. ..... 2/425; 2/410; 2/411; 2/412; 2/414

(58) Field of Classification Search ..... None
See application file for complete search history.

(56) References Cited

U.S. PATENT DOCUMENTS 1,719,706 A * 7/1929 Krans ..... 2/8.1
2,644,949 A * 7/1953 Greenberg et al. ..... 2/181
2,883,669 A * 4/1959 Rafowitz et al. ..... 2/172
2,962,723 A * 12/1960 Kronenberger ..... 2/181
3,242,500 A * 3/1966 Derr ..... 2/412
3,276,038 A * 10/1966 Fekete ..... 2/172
3,935,044 A * 1/1976 Daly ..... 156/79
4,091,469 A * 5/1978 Davidson ..... 2/410
4,439,871 A * 4/1984 Plastino ..... 2/422
4,575,871 A * 3/1986 Auerbach et al. ..... 2/6.6
4,698,852 A * 10/1987 Romero ..... 2/171
4,951,319 A * 8/1990 Phillips et al. ..... 2/172
5,226,180 A * 7/1993 Leach ..... 2/411
5,269,026 A * 12/1993 McManus ..... 2/411
5,289,591 A * 3/1994 Andersen ..... 2/411
5,313,668 A * 5/1994 Bogan et al. ..... 2/181.4
5,392,468 A * 2/1995 Leddick, III ..... 2/424
5,437,064 A * 8/1995 Hamaguchi ..... 2/414
5,519,895 A * 5/1996 Barnes, Jr. ..... 2/422
5,657,492 A * 8/1997 Esposito, Jr. ..... 2/410
5,729,830 A * 3/1998 Luhtala ..... 2/2.5
5,898,949 A * 5/1999 Barthold et al. ..... 2/416
5,991,930 A * 11/1999 Sorrentino ..... 2/424
6,401,258 B1 * 6/2002 Wilson ..... 2/410
6,467,099 B2 * 10/2002 Dennis et al. ..... 2/455
7,096,512 B2 * 8/2006 Blair ..... 2/410
7,103,923 B2 * 9/2006 Picotte ..... 2/412
7,328,462 B1 * 2/2008 Straus ..... 2/411
7,673,350 B2 * 3/2010 Mazzoccoli et al. ..... 2/411
2003/0119459 A1 * 6/2003 Carillo et al. ..... 455/114
2004/0025231 A1 * 2/2004 Ide et al. ..... 2/425
2004/0034903 A1 * 2/2004 Blair ..... 2/411

* cited by examiner

*Primary Examiner* — Bobby H Muromoto, Jr.
(74) *Attorney, Agent, or Firm* — Risto A. Rinne, Jr.

(57) ABSTRACT

An apparatus for use with a cap includes a rigid liner that is secured to an interior or exterior of the cap to provide impact protection over a portion of the forehead region, crown and temple area. An absorbent liner is preferably included if the cap does not include an interior liner. The absorbent liner absorbs perspiration from the brow of the wearer. An optional energy attenuating liner can also be included as an inner layer that is disposed adjacent to the rigid liner and intermediate the head of the wearer to more safely distribute kinetic energy. The energy attenuating liner can include a material that provides single-use only or multiple-use capability. The rigid liner and other components are either permanently attached to the cap or they may be detachably-attachable with respect to the cap or with respect to a remainder of the apparatus and replaced, as desired. Any preferred material may be used for any component part of the protective shield for a cap.

18 Claims, 2 Drawing Sheets

PROTECTIVE SHIELD FOR A CAP

BACKGROUND OF THE INVENTION

1. Field of the Invention

The present invention, in general, relates to headgear and, more particularly, to a liner or shield that provides protection from impact to a cap.

A cap is a common type of headgear that is casually worn to enhance appearance or to provide shade. It is also commonly worn during the playing or watching of certain sports, including baseball, tennis and during other activities.

A cap is a lightweight type of headgear that includes a bill which projects forward and provides relief from the glare of the sun. The cap may also be worn backward, with the bill projecting over the nape of neck of the wearer for reasons of style or for utility, such as to prevent sunburn to the back of the neck or to ensure that other headgear, such as a catcher's mask, can be simultaneously worn.

However, a cap provides virtually no impact protection from flying objects. This need is most acute for a baseball pitcher who is at risk of impact from a ball that is struck by a batter. The most danger to the pitcher is from impact of a line-drive, which is a ball that is struck in the center of the bat and flies directly toward the pitcher along a flight path that simulates a nearly straight line. This is because a baseball struck in this manner will be traveling at especially high velocity which decreases the apparent parabolic arc over a short distance of travel.

The high speed of the ball also decreases the amount of time that the pitcher has available to react in response to the rapidly approaching ball in order to get out of the ball's way. Also, the higher velocity of the ball means that it will also have a significant amount of kinetic energy to dissipate upon impact.

While there is risk of injury to the pitcher from being struck anywhere on the body by a baseball (or softball) that has been smartly struck, the risk is greatest if the pitcher is impacted on the head. Because of the physical position the pitcher acquires after release of the ball, if the pitcher is struck in the head impact is most likely to occur on the forehead or along upper portion of the forehead and front top of the skull or along the sides of the head, near temple and forehead regions of the head.

There is risk that such an impact can result in a concussion or a skull fracture occurring and, therefore, there is also the risk of the pitcher entering into a coma or even the possibility of death occurring as a result of such an impact.

The pitcher, who is at greatest risk, is also unable to wear more protective types of headgear as the safer headgear would interfere with the windup motion and with the release of the baseball, thereby adversely affecting placement (accuracy) and velocity. This is because more protective headgear is also bulkier and heavier than a cap and is therefore more likely to interfere with peripheral vision, as is used by a pitcher during delivery of the ball.

Therefore, a long-felt need to protect the head of a pitcher from trauma resulting from impact of a struck baseball has remained unsolved as pitchers of all ability levels continue to wear a basic baseball cap whenever they are engaged in pitching.

Additionally, there is a vanity as well as a strategic component involved in that the pitcher does not desire to appear, in anyway, afraid of the batter. Quite the contrary, the pitcher wants to appear in command of the situation and to intimidate the batter, rather than give the appearance to the batter that he, or she, is intimidating the pitcher. Similarly, the pitcher does not want spectators to observe that he or she is wearing protective headgear during pitching.

Similarly, there is a need to provide frontal area impact protection to the head of person wearing a cap during times of casual wear as well as when engaged in the playing of various sports and other activities. This is needed to provide additional safety from objects that may impact the head of the wearer, including protection to the head of the wearer if it is the wearer that falls and impacts some stationary or other type of object.

Additionally, people with special medical needs such as those recovering from a head injury or surgery to the head (or brain) are in need of greater impact protection for their head and would prefer to achieve such protection in an optimally comfortable and inconspicuous manner.

With regard to providing impact protection to the head for sporting activities it is noted that the use of a helmet is the standard teaching as to a solution for this need. Therefore, the teaching of the prior art is toward protective devices (i.e., helmets) that are modified for each sport but which are generally heavy, cumbersome, bulky, obstruct the field-of-view, and have an appearance that clearly indicates their utilitarian purpose.

Accordingly, there exists today a need for a protective shield for a cap that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of the relevant prior art, the instant invention attests to its novelty. Therefore, by helping to provide a more elegant solution to various needs, some of which may be long-standing in nature, the instant invention further attests that the elements thereof, in the combination as claimed, are not obvious when viewed in light of the teachings of the known prior art.

Clearly, such an apparatus would be useful and desirable.

2. Description of Prior Art

Caps, helmets, and protective headgear are, in general, known. Some of these known devices may or may not have relevance to the invention. An acknowledgement of their existence is not an admission of their having any particular relevance to the invention but rather is intended to present a broad and diversified understanding regarding the current state of the art appertaining to either the field of the invention or possibly to other related or distal fields of invention.

While the structural arrangements of the previously known types of devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a protective shield for a cap that is aesthetically pleasing.

It is also an important object of the invention to provide a protective shield for a cap that does not significantly alter the appearance of the cap.

Another object of the invention is to provide a protective shield for a cap that does not give the cap the appearance of it being a type of protective headgear.

Still another object of the invention is to provide a protective shield for a cap that looks like a conventional baseball cap.

Still yet another object of the invention is to provide a protective shield for a cap that includes a protective safety liner attached to the cap.

Yet another important object of the invention is to provide a protective shield for a cap that includes a protective safety liner attached to an interior of the cap.

Still yet another important object of the invention is to provide a protective shield for a cap that includes a protective safety liner attached to an exterior of the cap.

A first continuing object of the invention is to provide a protective shield for a cap that provides impact protection to certain areas of the head of the wearer.

A second continuing object of the invention is to provide a protective shield for a cap that includes a protective safety liner that is detachably-attachable with respect to the cap.

A third continuing object of the invention is to provide a protective shield for a cap that provides impact protection to the forehead region of the skull.

A fourth continuing object of the invention is to provide a protective shield for a cap that provides impact protection to the forehead and surrounding proximal regions of the skull.

A fifth continuing object of the invention is to provide a protective shield for a cap that includes an absorbent liner.

A sixth continuing object of the invention is to provide a protective shield for a cap that includes a rigid liner for distributing impact energy over a wider area.

A seventh continuing object of the invention is to provide a protective shield for a cap that includes a rigid liner for distributing impact energy over a wider area and an energy absorbing liner adjacent to the rigid liner.

An eighth continuing object of the invention is to provide a protective shield for a cap that provides increased impact protection for people with special needs, such as those recovering from brain surgery, concussion and other types of head-injury, hemophiliacs, the elderly and infirm, as well as those without special need but who would nevertheless prefer added impact protection for their head as inconspicuously as possible.

Briefly, a protective shield for a cap that is constructed in accordance with the principles of the present invention has a rigid liner over a portion of the forehead region and extending back to the temple area. A breathable absorbent liner is preferably included and is in contact with the head. An optional energy attenuating liner may also be included as an inner layer that is adjacent to the rigid liner and under the absorbent liner. The rigid liner and other components are either permanently attached to the cap or they may be detachably-attachable with respect to the cap and replaced, as desired. Any preferred material may be used for any component part of the protective shield for a cap.

DETAILED DESCRIPTION OF THE INVENTION

Figure 1:
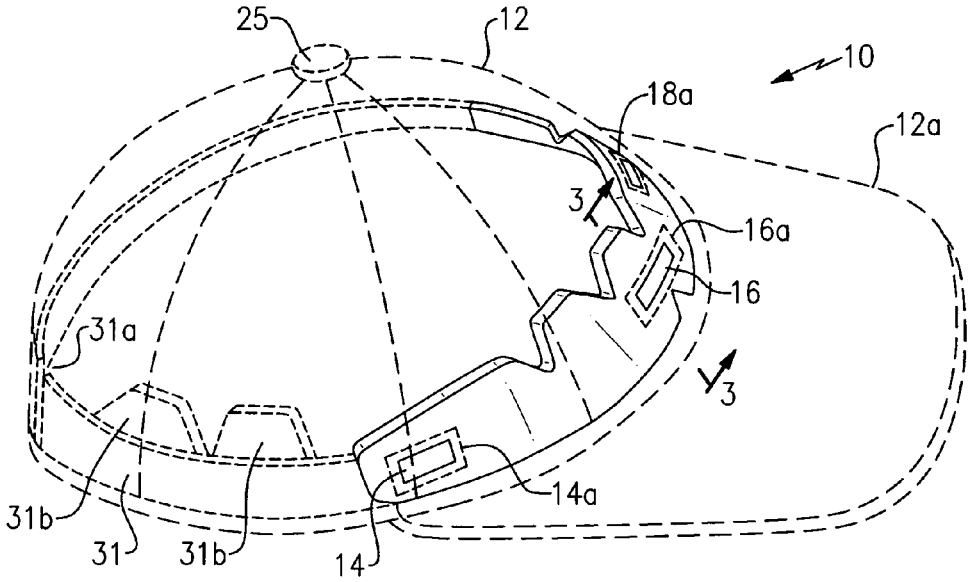
FIG. 1 is a view in perspective of a protective shield for a cap disposed inside a cap, the cap being shown in dashed lines.

Referring on occasion to all of the FIGURE drawings and now, in particular to FIG. 1, is shown a protective shield for a cap, identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

The protective shield for a cap 10 is shown inside of a cap 12. The cap 12 and permanently attached components of the cap 12 are shown in dashed lines to optimally show placement of the protective shield for a cap 10 in the cap 12 and to better reveal construction of the protective shield for a cap 10. The cap 12 includes a bill 12*a* that extends forward of the cap 12. The cap 12 may be newly manufactured and include modifications that are included for use with the protective shield for a cap 10. Alternately, the cap 12 may include any currently available prior-art type of the cap 12. The protective shield for a cap 10 can be included as a component during manufacture of the cap 12 or the protective shield for a cap 10 can be added to most preexisting prior-art types of the cap 12. This is discussed in greater detail hereinafter.

Figure 2:
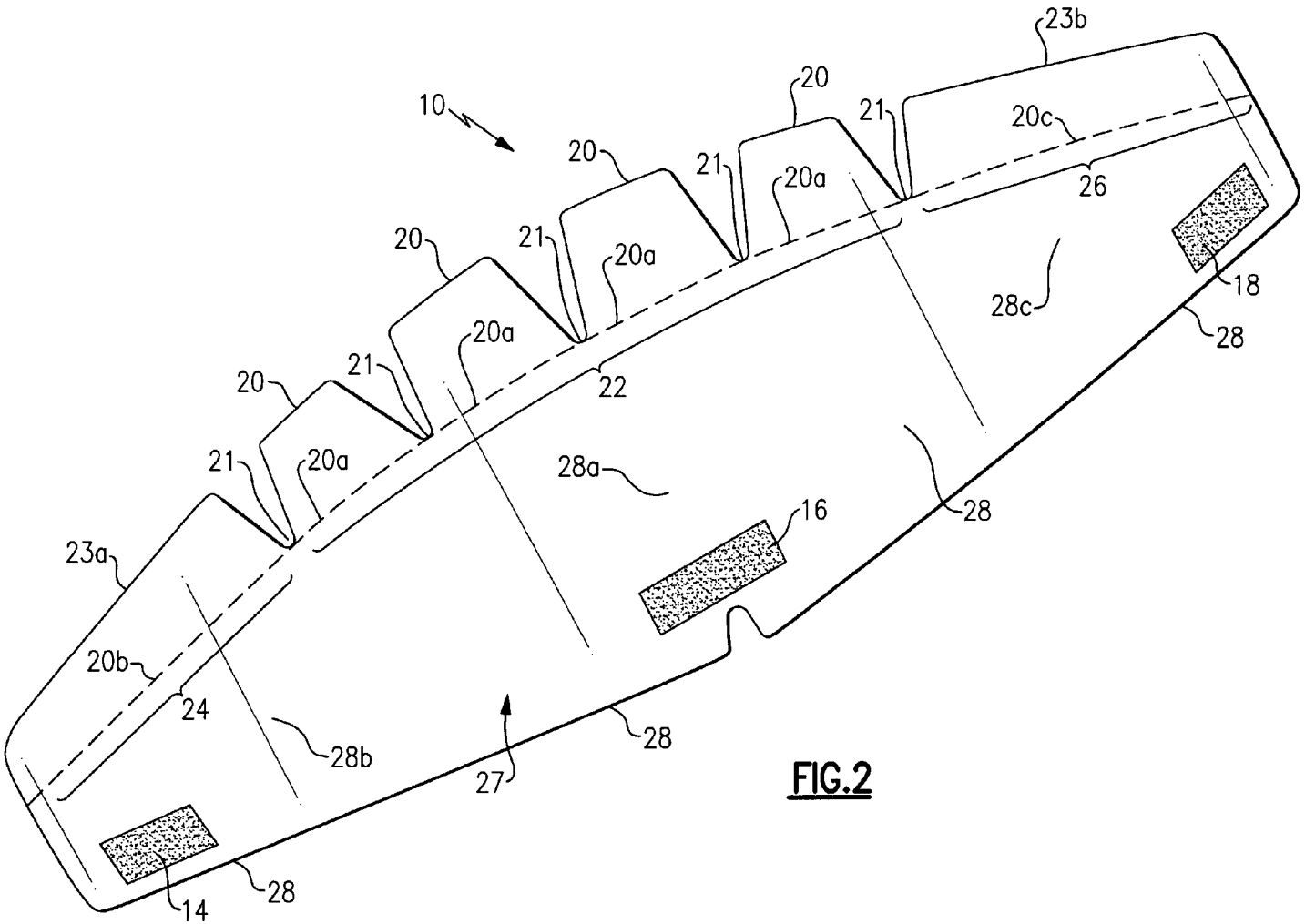
FIG. 2 is a front elevational view of the protective shield for a cap of FIG. 1 with the shield shown flat, prior to bending into the desired shape.

Referring now also to FIG. 2, the protective shield for a cap 10 includes a first hook and loop fastener 14, a second hook and loop fastener 16, and a third hook and loop fastener 18, such as the well-known fastener sold under the tradename of "VELCRO™" that are each attached to the protective shield for a cap 10, such as by the use of an adhesive. The first, second, and third hook and loop fasteners 14, 16, 18 are made of either the first or second half of a hook and loop type of fastener whereby each portion (14, 16, 18) is formed of either the hook portion (herein referred to as the "first half" of the hook and loop fastener) or the loop portion (herein referred to as the "second half" of the hook and loop fastener), as desired.

Corresponding approximately in size and position of the first, second, and third hook and loop fasteners 14, 16, 18 are provided a corresponding first hook and loop mating portion 14*a*, a second hook and loop mating portion 16*a*, and a third hook and loop mating portion (not shown) that are each permanently attached to the cap 12 (and therefore shown in dashed lines in FIG. 1). If the first hook and loop fastener 14 includes the first half, then the corresponding first hook and loop mating portion 14*a* to which the first hook and loop fastener 14 is attached would be formed of the second half. Alternately, if the first hook and loop fastener 14 includes the second half, then the corresponding first hook and loop mating portion 14*a* to which the first hook and loop fastener 14 is attached would be formed of the first half. The same applies for the remaining second and third hook and loop fasteners 16, 18 and the corresponding second and third hook and loop mating portions 16*a*, 18*a*. Either greater or fewer numbers of hook and loop fasteners (the first and second halves) may be used than the three that are shown herein, as deemed necessary or desirable and their size and placement on the protective shield for a cap 10 and on the cap 12 are varied, as desired. If desired, only one larger hook and loop fastener can be used to replace the first, second, and third hook and loop fasteners 14, 16, 18.

Accordingly, when the protective shield for a cap 10 is properly positioned inside the cap 12 and is urged against the front of the cap 12, the corresponding hook and loop portions engage (14 with 14*a*, 16 with 16*a*, and 18 with 18*a*) to secure the protective shield for a cap 10 in position inside the cap 12. To remove the protective shield for a cap 10 from the cap 12, the protective shield for a cap 10 is grasped and a sufficient force is applied to separate the hook and loop fasteners 14, 16, 18 and allow removal of the protective shield for a cap 10 from the cap 12 for inspection, cleaning or replacement.

The protective shield for a cap 10 may be formed from a sheet of titanium, aluminum, plastic, or any other material, as desired, including any preferred type of composite material. It is desirable that the protective shield for a cap 10 be as thin and as lightweight as possible. If the protective shield for a cap 10 is thin it is more difficult to observe its presence and the lighter it is the less noticeable it is to the wearer of the cap 12. The lighter the protective shield for a cap 10 the less it will interfere with the head movement of the wearer, including sudden changes in the direction in which the head is oriented such as a baseball pitcher is likely to experience when suddenly changing the direction of their gaze, for example, to check the position of a base-runner of the opposing team.

A plurality of upper protruding tabs 20 that are each separated by intermediate V-shaped notches 21 are provided, as desired, and are useful if the protective shield for a cap 10 is formed from a sheet of metallic stock, such as titanium or aluminum. The metallic stock is initially preferably stamped from a flat sheet of stock (as shown in FIG. 2) and is then bent to include a curvature around the forehead and a shaper radius to extend back around the temples of the wearer. The stock is then bent inward along a line (dashed line 20*a*) extending between a bottom of each of the V-shaped notches 21, as defined by bracket 22. The protruding tabs 20 are each curved inward (into the paper, as shown in FIG. 2) a variable amount (as desired) to generally follow a change in the contour of the head that occurs above the forehead.

The V-shaped notches 21 allow clearance between the protruding tabs 20 as the protruding tabs 20 are bent inward. As desired, a pair of upper side wings 23*a* and 23*b* are disposed on each side of the protruding tabs 20, as defined by bracket 24 and by bracket 26. The upper side wings 23*a*, 23*b* may also be bent inward slightly (along dashed lines 20*b* and 20*c*, respectively) to conform to the contour of the skull (head) exterior and the generally hemispherical shape that exists inside the cap 12. One of the V-shaped notches 21 also separates each of the upper side wings 23*a*, 23*b* from an adjoining one of the protruding tabs 20.

An advantage to forming the protective shield for a cap 10 out of metallic stock is that the amount that each of the protruding tabs 20 as well as the amount the left upper side wing 23*a* and the right upper side wing 23*b* are each bent inward can be customized (i.e., urged slightly further inward or outward by the application of sufficient force or the use of pliers and a vice) by the wearer to tailor the shape of the protective shield for a cap 10 to correspond more accurately with the shape of the wearer's head.

When the contour of the protective shield for a cap 10 closely corresponds with that of the head of the wearer, it provides the unexpected benefit of removing virtually all external indication (i.e., there are no departures in the smooth contour of the cap 12) that might tend to suggest or otherwise indicate that the protective shield for a cap 10 is disposed in the cap 12. Accordingly, the cap 12 appears to the casual observer as any ordinary type of existing cap (not shown).

The protective shield for a cap 10 can also be formed out of plastic or other material as is discussed in greater detail, hereinafter.

The protruding tabs 20 provide significant impact protection to the head immediately above the forehead and protect this area of the head from direct (or glancing) impact. It is not necessary that the protruding tabs 20 should extend more fully toward a top center 25 of the cap 12 (although this modification is possible if desired) in order to provided impact protection for this area (i.e., the upper crown area) of the head. This is because if a line-drive is struck, for example, that impacts any portion of the area protected by the protruding tabs 20, the protruding tabs 20 will absorb any direct impact by the ball that might occur to the head in the area that is immediately above the forehead while also deflecting any impact by the ball that might occur to a frontal region of the upper crown area of the head by causing the ball to glance off the top of the protruding tabs 20 and, in this manner, redirect the flight path of the ball away from the upper crown area and away from the top of the head (i.e., the uppermost top of the crown that is disposed under the top center 25 of the cap 12).

Accordingly, impact to the front and upper (crown) portions of the pitcher's head is prevented from occurring by the protective shield for a cap 10. This expansive scope in protection to the crown area is due to the final position that is attained by the pitcher's body and head after having completed delivery of the pitch to a batter. The pitcher does not allow his/her head to face directly downward after the ball has been released. Accordingly, the pitcher does not expose the top of the crown of his/her head to the risk of direct impact from the ball. Rather, the pitcher always maintains the batter in his/her field of view and, accordingly, must keep at least a portion of their face directed toward the batter at all times during and after delivery of the ball. This ensures that the crown of the head can be protected from impact by diverting the flight path of a ball (rather than having to absorb all of the kinetic energy of the ball) so that it glances off of the protruding tabs 20 and away from the upper crown area of the head.

As a possible modification to the protective shield for a cap 10, the protruding tabs 20 could be modified to include extended protruding tabs (not shown) that each extended further than the protruding tabs 20 and which terminate as close to the top center 25 of the cap 12, as is desired.

A main body portion 28 is that portion below the protruding tabs 20 (below dashed line 20*a*) and below the upper side wings 23*a*, 23*b* (below dashed lines 20*b* and 20*c*). The main body portion 28 includes a central main portion 28*a* that is disposed under the protruding tabs 20 (below dashed line 20*a*). The central main portion 28*a* provides impact protection to the forehead of the wearer and protects from direct as well as glancing impacts to this area.

The main body portion 28 includes a left main portion 28*b* that is disposed under a first of the upper side wings 23*a* (below dashed line 20*b*) and the main body portion 28 includes a right main portion 28*c* that is disposed under a second of the upper side wings 23*b* (below dashed line 20*c*). The left main portion 28*b* and the right main portion 28*c* provide impact protection to the temple areas of the wearer. The upper side wings 23*a*, 23*b* extend impact protection over and above the temple areas.

A rigid liner (identified in general by the reference numeral 27) is provided by the main body portion 28 (including the central main portion 28*a*, the left main portion 28*b*, and the right main portion 28*c*), the left upper side wing 23*a* and the right upper side wing 23*b* and all of the protruding tabs 20. The rigid liner 27 absorbs the kinetic energy of the ball by distributing the kinetic energy over a wider area of the skull (i.e., the head) thereby helping to protect the head of the wearer from trauma caused by impact. The rigid liner 27 is sufficiently rigid (inflexible) so not to deform substantially or fracture at the point of impact providing that the kinetic energy is less than a predetermined maximum level. This ensures that the kinetic energy will be distributed over a wider area of the head (i.e., skull) thereby lessening to a substantial degree the potential for severe damage occurring to the head. The rigid liner 27 includes the structures (except for the first, second, and third hook and loop fasteners 14, 16, and 18) as shown in FIG. 2.

Figure 3:
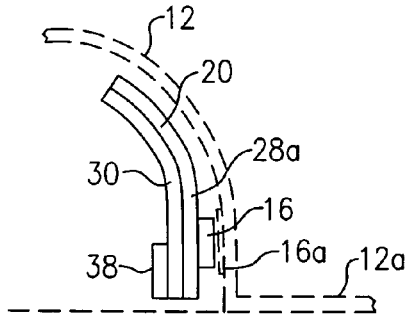
FIG. 3 is a cross sectional view taken on the line 3-3 in FIG. 1.

Referring now primarily to FIG. 3 is shown the protective shield for a cap 10 in cross-section. Attached to an inside of the rigid liner 27 is an energy attenuating liner 30 that is in the form of a sheet that is disposed adjacent to the rigid liner 27. A sufficiently dense type of foam or styrofoam or elastic material can be used, as desired. It is preferred to use as lightweight and as energy absorbing a material as possible for the energy attenuating liner 30. For certain applications of the protective shield for a cap 10 (or a modified protective shield for a cap 10*a*, as is described in greater detail hereinafter), the energy attenuating liner 30 can be omitted.

It may also be preferred (for certain applications) to place emphasis on the energy absorbing capability of the energy attenuating liner 30 and on its low weight over any other factor, such as its ability to repeatedly absorb impact energy. In such instances, it is acceptable that the energy attenuating liner 30 should only provide impact protection for one impact, after which either the energy attenuating liner 30 or the entire protective shield for a cap 10 (or the modified protective shield for a cap 10*a*, as is described in greater detail hereinafter) or the entire cap 12 with the protective shield for a cap 10 (or with the modified protective shield for a cap 10*a*) would then need to be replaced in order to restore the protective qualities of the protective shield for a cap 10 (or of the modified protective shield for a cap 10*a*).

The energy attenuating liner 30 absorbs the kinetic energy of the ball by its compression under load over a wider area thereby protecting the head of the wearer from excessive trauma. If Styrofoam is used to form the energy attenuating liner 30, the Styrofoam is crushed during a sufficiently strong impact (i.e., during energy absorption) and, therefore, can only provide impact protection for one such impact.

The energy absorbing liner (or the protective shield for a cap 10 or the modified protective shield for a cap 10*a*) may need to be replaced after a predetermined period of time has elapsed due to aging and a resultant degradation of the efficacy of the energy absorbing liner 30 or any other component part of the protective shield for a cap 10 that may limit its life-expectancy.

As desired, if the protective shield for a cap 10 (or the modified protective shield for a cap 10*a*) is not removable from the cap 12, then the entire cap 12 including the protective shield for a cap 10 (or the modified protective shield for a cap 10*a*) will require replacement after each significant impact if the energy absorbing liner 30 is formed of a non-elastic material.

If the protective shield for a cap 10 (or the modified protective shield for a cap 10*a*) is removable from the cap 12, then the protective shield for a cap 10 (or the modified protective shield for a cap 10*a*) will need to be replaced, however, the cap 12 may still be reusable. If the energy absorbent liner 30 is designed to be replaceable separate from a remainder of the protective shield for a cap 10 (or separate from a remainder of the modified protective shield for a cap 10*a*) then only the energy absorbent liner 30 will need to be replaced after each significant impact.

As a further possible modification, the protective shield for a cap 10 could be extended so that it includes a lower band (identified by dashed line and reference numeral 31, FIG. 1) that extends outward in a circle from the distal opposite sides of the protective shield for a cap 10 and wraps completely around an inside of the cap 12 to form a complete circle or, if desired, a slight gap 31*a* could be provided between the ends of the lower band 31 at a rear of the cap 12. A plurality of additional rear protruding tabs 31*b* (only a two are shown) that are similar to the protruding tabs 20 of the front can also be included and attached to the lower band 31. The rear protruding tabs 31*b* could also be bent inward and extend up and toward the top center 25 of the cap 12 any desired amount to provide impact protection to the back of the head as well and to do so as inconspicuously as possible. The rear protruding tabs 31*b* could be further modified to extend upward toward the top center 25 of the cap 12 as much as desired.

The protective shield for a cap 10 can also be formed of a single molded sheet of plastic (any preferred type). If desired, a general size that is suitable for most wearer's could be provided or a variety of different sizes including, if desired, variations in the length and curvature of the protruding tabs 20 could be provided.

As mentioned above, the protective shield for a cap 10 can be included in the cap 12 when the cap 12 is offered for sale as a newly manufactured product or, alternately, the protective shield for a cap 10 could be provided as a separate product for inclusion later with a conventional and unmodified preexisting type of a cap 12. The conventional type of cap 12 does not have the corresponding first hook and loop mating portion 14*a*, the corresponding second hook and loop mating portion 16*a*, and the corresponding third hook and loop mating portion 18*a* attached thereto. The first, second, and third hook and loop mating portions 14*a*, 16*a*, 18*a* can be attached to the conventional type of the cap 12 by the manufacturer or by the wearer as an aftermarket modification that is made to the cap 12. For aftermarket use of the protective shield for a cap 10 with already existing (conventional) types of the cap 12, the protective shield for a cap 10 (i.e., preferably as a kit) would be provided with the corresponding first hook and loop mating portion 14*a*, the corresponding second hook and loop mating portion 16*a*, and the corresponding third hook and loop mating portion 18*a* that would be attached to the cap 12 by the use of an adhesive (i.e., a peel-off or thermal adhesive) or by sewing. The aftermarket kit would also include all of the component parts of the protective shield for a cap 10 for use with the conventional type of the cap 12. In this manner, preexisting caps 12 could be easily modified to include the protective shield for a cap 10 and provide the wearer with impact protection.

Figure 4:
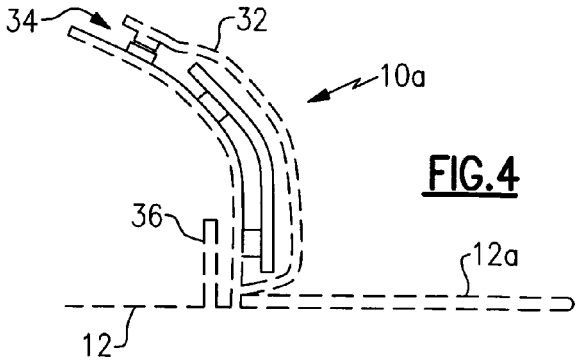
FIG. 4 is a cross sectional view of a modification to the shield that is similar to that shown in FIG. 3 with the protective shield disposed on an exterior portion of the cap.

When protective shield for a cap 10 is included as part of the cap 12 as a newly manufactured product the protective shield for a cap 10 can be detachably-secured to the cap 12 by the first, second, and third hook and loop fasteners 14, 16, 18 mating respectively with the corresponding first hook and loop mating portion 14*a*, the corresponding second hook and loop mating portion 16*a*, and the corresponding third hook and loop mating portion 18*a*. Alternately, the protective shield for a cap 10 could be permanently attached to the cap (for sale with the cap 12) by the use of an adhesive or by sewing the protective shield for a cap 10 to the cap 12 (for example, by first attaching a cloth perimeter to the protective shield for a cap 10 and then sewing the cloth perimeter to the cap 12) or, alternately, by including a fabric pocket (as shown in FIG. 4) that is attached to the cap 12 (either to the inside or the outside of the cap 12, as described below) and inserting the protective shield for a cap 10 in the fabric pocket. The fabric pocket could be sewn shut after the protective shield for a cap 10 is inserted therein or the fabric pocket could include a closure (such as VELCRO™) for securing the protective shield for a cap 10 in the fabric pocket. The closure would allow opening of the fabric pocket for removal of the protective shield for a cap 10 for inspection and/or replacement of the protective shield for a cap 10 or the energy absorbing liner 30.

Referring now to FIG. 4, the protective shield for a cap 10 can also be modified, as desired, to provide the modified protective shield for a cap (shown in general by the reference numeral 10*a*) in which the modified protective shield for a cap 10*a* is disposed outside of the hemispherical cavity of the cap 12. As used herein, the hemispherical cavity refers to that portion of the cap 12 into which an upper portion of the head of wearer is normally disposed when the cap 12 is worn.

To help conceal the modified protective shield for a cap 10*a*, if it is disposed at an exterior rather than at an interior portion of the cap 12, the cap 12 could also be modified to include an exterior pocket (identified by dashed line 32) made of fabric that is sized to contain the modified protective shield for a cap 10*a*.

The exterior pocket 32 is disposed on an exterior of the cap above the bill 12*a* and it includes any desired size that is necessary to accommodate the size and shape of the modified protective shield for a cap 10*a*. The location on the cap 12 of the modified protective shield for a cap 10*a* is generally the same as the preferred location of the protective shield for a cap 10, except that the modified protective shield for a cap 10*a* is disposed adjacent to an outside surface of the hemispherical cavity of the cap 12 while the protective shield for a cap 10 is disposed adjacent to an inside surface of the hemispherical cavity of the cap 12.

The size of the modified protective shield for a cap 10*a* can be varied as previously described for the protective shield for a cap 12. If the exterior pocket 32 is formed of the same or similar material that is used to form the cap 12, the exterior pocket 32 will aid in hiding the presence of the modified protective shield for a cap 10*a*.

If desired, the exterior pocket 32 can be sewn shut so the modified protective shield for a cap 10*a* is not accessible for inspection or replacement by the wearer of the cap 12. This may be preferred for some markets to increase cap 12 sales.

If desired, the exterior pocket 32 can be modified to provide access to an interior thereof for removal and insertion of the modified protective shield for a cap 10*a* by including, where desired, a modified closure, identified in general by the reference numeral 34. The modified closure 34, as shown, is preferably made using a hook and loop fastener, such as that sold under the tradename of VELCRO™ or, if preferred, any other type of fastener (zipper, button, etc.) can be used to permit inspection and/or replacement of the modified protective shield for a cap 10*a*.

An advantage to the use of the modified protective shield for a cap 10*a* is that exterior placement allows the interior of the cap 12 to remain substantially unchanged as compared to prior-art types of caps (not shown). Therefore, all prior art types of caps that are currently in-use can be modified to include the modified protective shield for a cap 10*a* by providing an aftermarket kit that includes all of the external component parts of the modified protective shield for a cap 10*a* that are necessary.

The modified protective shield for a cap 10*a* could be sewn to the outside of the cap 12 or attached by adhesive. It could be designed to allow inspection or removal and replacement of the modified protective shield for a cap 10*a*, or not, as desired. If inspection and/or replacement of the modified protective shield for a cap 10*a* is desired and when it is desired that the modified protective shield for a cap 10*a* is to be added (by the end-user or wearer of the cap 12) to an existing type of cap 12, or when the protective shield for a cap 10 is used with a newly manufactured cap 12 another possible method of attachment is available if VELCRO™ (i.e., a hook and loop fastener) is used to secure the modified closure 34 or if VELCRO™ is used to secure the protective shield for a cap 10 inside of the cap 12 (i.e., inside the hemisphere of the cap 12).

In either instance the VELCRO™ can be extended either partially or fully around the perimeter of the exterior pocket 32 or around the protective shield for a cap 10 (inside the hemispherical cavity of the cap 12). If either is to be an after-market kit (i.e., for the wearer to install) then each kit (for either the protective shield for a cap 10 or for the modified protective shield for a cap 10*a*) could include the first half of the hook and loop fastener (i.e., the VELCRO™) with a sufficiently strong adhesive that the wearer would apply where directed (according to a template that was provided) to the cap's 12 interior (for the protective shield for a cap 10).

The kit would also then include an interior pocket for insertion and containment of the protective shield for a cap 10. The interior pocket provided in the kit would include the second half of the hook and loop fastener, attached to the interior pocket by the kit manufacturer to correspond with the positioning of the template. This would then permit detachably-attaching the interior pocket to the first half of the hook and loop fastener that was added by the wearer to the cap's 12 interior.

If designing an aftermarket kit for use with the modified protective shield for a cap 10*a*, then the exterior pocket 32 would be included in the kit for attachment, similar to that described above, to the cap's 12 exterior. The modified protective shield for a cap 10*a* would be inserted in the newly attached exterior pocket 32. For either kit, access is provided to inspect and/or replace the protective shield for a cap 10 or the modified protective shield for a cap 10*a*, as desired. Numerous other ways of providing an aftermarket kit for use with either the protective shield for a cap 10 or the modified protective shield for a cap 10*a* are possible.

Another advantage to the use of the modified protective shield for a cap 10*a* is that a normal interior liner (identified by dashed line and by reference numeral 36, FIG. 4) that is (or may be) currently provided with certain prior-art types of the cap 12 can still be used to wick perspiration from the brow of the wearer. This is useful in keeping perspiration off of the eyes during competitive or strenuous activities. The interior liner 36 is made of fabric and it is attached to a lower rim of the cap 12 and folded up and inward so that it is disposed in an interior of the hemispherical chamber of the cap 12.

When the protective shield for a cap 10 is used (i.e., inside of the cap 12), it is desirable to dispose the protective shield for a cap 10 so that a lower portion of the protective shield for a cap 10 is between the hemispherical portion and the interior liner 36 of the cap 12. If the cap 12 does not include the interior liner 36 then an absorbent liner 38 (FIG. 3) can optionally be included and attached to a lower portion of the protective shield for a cap 10.

When the cap 12 is worn, the absorbent liner 38 will be in contact with the forehead (brow) of the wearer to help absorb perspiration.

As desired, any desired image, logo, or any other decorative markings or lettering can be included on cap 12, as desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

The invention claimed is:

1. A protective shield for a cap, comprising:

(a) a substantially rigid liner including a curvature that approximates the curvature of a portion of a human head, and wherein said rigid liner is able to absorb and distribute over a greater surface area of said human head at least a portion of the kinetic energy of an object that impacts said cap at a location on said cap that is disposed over said rigid liner, and wherein said rigid liner extends over a portion of a forehead of a person who is wearing said cap, and wherein said rigid liner includes a plurality of upper protruding tabs that are disposed along an upper surface of said rigid liner, and wherein each of said upper protruding tabs includes a generally trapezoidal shape, and wherein each adjacent pair of said upper protruding tabs includes an intermediate V-shaped notch that terminates in a point and which is disposed between each adjacent pair of said upper protruding tabs, and wherein each of said plurality of upper protruding tabs includes an inward deflection along a line extending along a bottom of all of said V-shaped notches, and wherein said inward curvature redirects a position of each of said plurality of upper protruding tabs closer toward a head of a wearer of said protective shield for a cap; and (b) means for securing said rigid liner to said cap at a desired location on said cap.

2. The protective shield for a cap of claim 1 wherein said means for securing said rigid liner to said cap includes means for securing said rigid liner to an interior of said cap.

3. The protective shield for a cap of claim 2 wherein said means for securing said rigid liner to said cap prevents inspection or replacement of said rigid liner.

4. The protective shield for a cap of claim 2 wherein said means for securing said rigid liner to said cap permits inspection or replacement of said rigid liner.

5. The protective shield for a cap of claim 1 wherein said means for securing said rigid liner to said cap includes means for securing said rigid liner to an exterior of said cap.

6. The protective shield for a cap of claim 5 wherein said means for securing said rigid liner to said cap prevents inspection or replacement of said rigid liner.

7. The protective shield for a cap of claim 5 wherein said means for securing said rigid liner to said cap permits inspection or replacement of said rigid liner.

8. The protective shield for a cap of claim 1 wherein said rigid liner extends over a portion of a temple of a person who is wearing said cap when said cap includes said protective shield.

9. The protective shield for a cap of claim 1 including a pocket attached to said cap for placement of said protective shield in said pocket.

10. The protective shield for a cap of claim 1 including a kit that includes sufficient materials for aftermarket attaching of said protective shield to said cap when said cap includes a pre-existing type of cap.

11. The protective shield for a cap of claim 10 wherein said kit includes sufficient materials for aftermarket attaching of said protective shield to an interior of said cap.

12. The protective shield for a cap of claim 10 wherein said kit includes sufficient materials for aftermarket attaching of said protective shield to an exterior of said cap.

13. The protective shield for a cap of claim 5 including a flexible covering over said rigid liner, whereby said rigid liner is not visible when viewing an exterior of said cap.

14. The protective shield for a cap of claim 1 wherein said means for securing said rigid liner includes a first half of a hook and loop fastener attached to said rigid liner and a second half of a hook and loop fastener attached to said cap.

15. The protective shield for a cap of claim 1 wherein said rigid liner includes an energy absorbing liner that is disposed over at least a portion of said rigid liner, and wherein said energy absorbing liner absorbs or dampens at least a portion of said kinetic energy of said object.

16. The protective shield for a cap of claim 15 wherein said energy absorbing liner includes a material that is crushed or altered upon said impact, providing said impact contains sufficient kinetic energy to crush or alter said material, wherein said energy absorbing liner must be replaced after every occurrence of said impact that contains sufficient kinetic energy.

17. The protective shield for a cap of claim 16 wherein said energy absorbing liner is detachable with respect to a remainder of said protective shield and, wherein after each occurrence of said impact that contains sufficient kinetic energy, said energy absorbing liner must be replaced on said protective shield.

18. The protective shield for a cap of claim 16 wherein said energy absorbing liner is not detachable with respect to a remainder of said protective shield and, wherein after each occurrence of said impact that contains sufficient kinetic energy, said energy absorbing liner and said remainder of said protective shield must be simultaneously replaced.

* * * * *